US011414616B2

(12) United States Patent
Sawaguchi

(10) Patent No.: US 11,414,616 B2
(45) Date of Patent: Aug. 16, 2022

(54) LUBRICATING GREASE COMPOSITION

(71) Applicant: NOK KLUEBER CO., LTD., Tokyo (JP)

(72) Inventor: Wataru Sawaguchi, Ibaraki (JP)

(73) Assignee: NOK KLUEBER CO., LTD., Tokyo (JP)

( * ) Notice: Subject to any disclaimer, the term of this patent is extended or adjusted under 35 U.S.C. 154(b) by 0 days.

(21) Appl. No.: 16/959,866

(22) PCT Filed: Dec. 2, 2019

(86) PCT No.: PCT/JP2019/046978
§ 371 (c)(1),
(2) Date: Jul. 2, 2020

(87) PCT Pub. No.: WO2020/129587
PCT Pub. Date: Jun. 25, 2020

(65) Prior Publication Data

US 2020/0332215 A1 Oct. 22, 2020

(30) Foreign Application Priority Data

Dec. 20, 2018 (JP) ..... JP2018-238817

(51) Int. Cl.

| | |
|---|---|
| ***C10M 169/00*** | (2006.01) |
| ***C10M 107/10*** | (2006.01) |
| ***C10M 105/18*** | (2006.01) |
| ***C10M 105/32*** | (2006.01) |
| ***C10M 107/04*** | (2006.01) |
| ***C10M 107/08*** | (2006.01) |
| ***C10M 117/00*** | (2006.01) |
| ***C10M 149/18*** | (2006.01) |
| ***C10M 169/02*** | (2006.01) |
| ***C10M 169/04*** | (2006.01) |
| *C10N 10/02* | (2006.01) |
| *C10N 20/02* | (2006.01) |
| *C10N 20/06* | (2006.01) |
| *C10N 30/08* | (2006.01) |
| *C10N 40/04* | (2006.01) |
| *C10N 50/10* | (2006.01) |

(52) U.S. Cl.

CPC ..... *C10M 107/10* (2013.01); *C10M 105/18* (2013.01); *C10M 105/32* (2013.01); *C10M 107/04* (2013.01); *C10M 107/08* (2013.01); *C10M 117/00* (2013.01); *C10M 149/18* (2013.01); *C10M 169/02* (2013.01); *C10M 169/041* (2013.01); *C10M 2205/003* (2013.01); *C10M 2205/026* (2013.01); *C10M 2205/0225* (2013.01); *C10M 2205/0285* (2013.01); *C10M 2207/0203* (2013.01); *C10M 2207/0406* (2013.01); *C10M 2207/106* (2013.01); *C10M 2207/2805* (2013.01); *C10M 2217/044* (2013.01); *C10N 2010/02* (2013.01); *C10N 2020/02* (2013.01); *C10N 2020/06* (2013.01); *C10N 2030/08* (2013.01); *C10N 2040/04* (2013.01); *C10N 2050/10* (2013.01)

(58) Field of Classification Search

CPC ..... C10M 107/10; C10M 105/18; C10M 105/32; C10M 107/04; C10M 107/08; C10M 117/00; C10M 149/18; C10M 169/02; C10M 169/041; C10M 2205/003; C10M 2205/0225; C10M 2205/026; C10M 2205/0285; C10M 2207/0203; C10M 2207/0406; C10M 2207/106; C10M 2207/2805; C10M 2217/044; C10M 169/06; C10M 2205/223; C10M 2205/0206; C10M 2205/0265; C10M 2215/222; C10M 2213/062; C10M 2201/062; C10M 2215/065; C10M 2207/1285; C10N 2010/02; C10N 2020/02; C10N 2020/06; C10N 2030/08; C10N 2040/04; C10N 2050/10; C10N 2030/76; C10N 2030/02; C10N 2030/06; C10N 2050/02

See application file for complete search history.

(56) References Cited

U.S. PATENT DOCUMENTS

2007/0075046 A1* 4/2007 Nakamura ..... C10M 169/00 218/123
2007/0232753 A1 10/2007 Monsheimer et al.
(Continued)

FOREIGN PATENT DOCUMENTS

CN 107406792 A 11/2017
CN 107429189 A 12/2017
(Continued)

OTHER PUBLICATIONS

Overview of Materials for Nylon 12 (Year: 2021).*
ISR issued in WIPO Patent Application No. PCT/JP2019/046978, dated Feb. 10, 2020, English translation.
(Continued)

*Primary Examiner* — Taiwo Oladapo
(74) *Attorney, Agent, or Firm* — Greenblum & Bernstein, P.L.C.

(57) ABSTRACT

A lubricating grease composition containing a base oil having a kinematic viscosity of 10 $mm^2/s$ or more and 60 $mm^2/s$ or less at 40° C.; a thickener containing at least one soap selected from a metal soap and a metal complex soap; and a solid lubricant containing porous polyamide particles. An amount of the porous polyamide particles blended is 1% by mass or more and 20% by mass or less based on a total mass of the lubricating grease composition.

7 Claims, No Drawings

(56) References Cited

U.S. PATENT DOCUMENTS

| | | | | |
|---|---|---|---|---|
| 2013/0256065 | A1* | 10/2013 | Bongaerts | B01J 20/24 184/102 |
| 2018/0016516 | A1 | 1/2018 | Sawaguchi et al. | |
| 2018/0016517 | A1 | 1/2018 | Sawaguchi et al. | |

FOREIGN PATENT DOCUMENTS

| | | | | |
|---|---|---|---|---|
| EP | 1 840 155 | | | 10/2007 |
| JP | H03-217496 | A | | 9/1991 |
| JP | H04-063895 | A | | 2/1992 |
| JP | H07-252490 | A | | 10/1995 |
| JP | 2001-164282 | A | | 6/2001 |
| JP | 2005-036133 | A | | 2/2005 |
| JP | 2009-013351 | A | | 1/2009 |
| JP | 2011-111475 | A | | 6/2011 |
| JP | 2011111475 | A | * | 6/2011 |
| JP | 2019-116949 | A | | 7/2019 |

OTHER PUBLICATIONS

1st Office Action issued in CN Patent Application No. 201980011261.4, dated Nov. 17, 2020, English translation.

English translation of IPRP and Written Opinion of International Search issued in WIPO Patent Application No. PCT/JP2019/046978, dated Jun. 16, 2021, English translation.

Office Action issued in DE Patent Application No. DE 11 2019 006 379.0, dated Jul. 30, 2021, English translation.

* cited by examiner

LUBRICATING GREASE COMPOSITION

CROSS REFERENCE TO RELATED APPLICATIONS

This is the National Stage of International Application No. PCT/JP2019/046978, filed Dec. 2, 2019, which claims the benefit of Japanese Patent Application No. 2018-238817 filed Dec. 20, 2018, and the full contents of all of which are hereby incorporated by reference in their entirety.

TECHNICAL FIELD

The present invention relates to a lubricating grease composition.

BACKGROUND ART

Conventionally, in sliding parts of gears and sliding members, a lubricating grease composition is used as a lubricant. As such a lubricating grease composition, a grease composition containing a base oil, a thickener, and melamine cyanurate (MCA) and polytetrafluoroethylene (PTFE) as a solid lubricant has been proposed (for example, see Patent Literature 1). In the grease composition described in Patent Literature 1, the amounts of the melamine cyanurate and polytetrafluoroethylene blended are within a predetermined range based on the total mass of the grease composition, and the blending ratio of the melamine cyanurate and polytetrafluoroethylene is within a predetermined range. This achieves a grease composition which has both lubrication performance provided by reducing a coefficient of dynamic friction and a quiescence function provided by increasing a coefficient of static friction.

DOCUMENT LIST

Patent Literature

Patent Literature 1: Japanese Patent Application Publication No. 2009-13351

SUMMARY OF INVENTION

Technical Problem

In recent years, resin members have been increasingly used for sliding parts of gears and sliding members in automobile parts, for the purpose of weight saving and cost saving. In reduction gear parts in reduction gears in automobiles, greases providing a high coefficient of static friction between sliding members have been required for preventing sliding during quiescence from the viewpoints of safety and crime prevention. Furthermore, greases used for a sliding part between resin members or between a resin member and a metal member as such a sliding member have also been required to have excellent durability. Here, the durability means that a coefficient of static friction after sliding for a long time is not reduced. From the viewpoint of recent electric power saving, the greases have been increasingly required to have excellent starting performance in order to reduce a starting voltage at the time of starting. Here, the starting performance means a low coefficient of static friction at the time of starting after quiescence for a long time under a high load. Furthermore, low-temperature performance has also been severely required, and the greases have also been required to have excellent low-temperature performance.

While the grease composition described in Patent Literature 1 has both a lubrication function and a quiescence function, the quiescence function, durability, and low-temperature performance of the grease composition, which have recently been required, may not be necessarily sufficient. Therefore, a lubricating grease composition has been desired, which can provide an increased coefficient of static friction between sliding members, and has an excellent quiescence function, durability, and low-temperature performance.

The present invention has been made in view of such actual conditions, and provides a lubricating grease composition which can provide an increased coefficient of static friction between sliding members and has excellent starting performance, durability, and low-temperature performance.

Solution to Problem

A lubricating grease composition according to the present invention contains a base oil having a kinematic viscosity of 10 $mm^2/s$ or more and 60 $mm^2/s$ or less at 40° C.; a thickener containing at least one soap selected from the group consisting of a metal soap and a metal complex soap; and a solid lubricant containing porous polyamide particles, in which an amount of the porous polyamide particles blended is 1% by mass or more and 20% by mass or less based on a total mass of the lubricating grease composition.

In the lubricating grease composition according to the present invention, the kinematic viscosity of the base oil at 40° C. is 10 $mm^2/s$ or more, whereby the viscosity of the base oil moderately decreases, so that, even if a sliding member is quiescent under a high load for a long time, the starting performance is not deteriorated. In the lubricating grease composition, the kinematic viscosity of the base oil at 40° C. is 60 $mm^2/s$ or less, whereby the viscosity of the base oil moderately increases, so that, even if sliding between the sliding members is performed for a long time, the coefficient of static friction of a sliding part is highly maintained to provide improved durability, and an increase in a torque is suppressed even under low-temperature conditions to provide improved low-temperature performance. Furthermore, the amount of the porous polyamide particles blended is 1% by mass or more and 20% by mass or less based on the total mass of the lubricating grease composition, whereby the porous polyamide particles are contained in a moderate amount in the lubricating grease composition, so that the coefficient of static friction increases to provide improved durability and starting performance. Therefore, the lubricating grease composition can provide an increased coefficient of static friction between the sliding members and impart excellent starting performance, durability, and low-temperature performance.

In the lubricating grease composition, the porous polyamide particles preferably have a specific surface area of 2.0 $m^2/g$ or more and an average particle diameter of 1 μm or more and 30 μm or less. By the formation, the specific surface area of the porous polyamide particles contained in the lubricating grease composition is 2.0 $m^2/g$ or more, whereby the average particle diameter of the solid lubricant moderately increases to provide good affinity of the solid lubricant for the base oil. Thus, even if the lubricating grease composition is quiescent under a high load for a long time, the coefficient of static friction at the time of starting decreases to provide improved starting performance. In the lubricating grease composition, the average particle diameter of the porous polyamide particles is 1 μm or more, whereby the average particle diameter of the porous polyamide particles moderately increases to provide an increased coefficient of static friction between the sliding members using the lubricating grease composition. In the lubricating grease composition, the average particle diameter of the porous polyamide particles is 30 μm or less, whereby the porous polyamide particles are likely to enter into between the sliding parts of the sliding members to provide an increased coefficient of static friction. Therefore, the lubricating grease composition can provide a further increased coefficient of static friction between the sliding members, and can exhibit excellent starting performance, durability, and low-temperature performance.

In the lubricating grease composition, the thickener is preferably at least one soap selected from the group consisting of a lithium soap and a lithium complex soap. In the formation, in the lubricating grease composition, the thickener contains the lithium soap and lithium complex soap having excellent heat resistance, whereby the coefficient of static friction between the sliding members can be further increased.

In the lubricating grease composition, the base oil preferably contains at least one synthetic oil selected from the group consisting of a synthetic hydrocarbon oil, an ester-based synthetic oil, an ether-based synthetic oil, and a glycol-based synthetic oil. Thus, a moderate viscosity is imparted to the lubricating grease composition by the base oil, whereby the coefficient of static friction can be further increased to provide further improved starting performance, durability, and low-temperature performance.

In the lubricating grease composition, the base oil preferably contains at least one synthetic hydrocarbon oil selected from the group consisting of poly-α-olefin, an ethylene-α-olefin oligomer, an ethylene-α-olefin copolymer, polybutene, alkylbenzene, and alkyl naphthalene. Thus, a moderate viscosity is imparted to the lubricating grease composition by the base oil, whereby the coefficient of static friction can be further increased to provide further improved starting performance, durability, and low-temperature performance.

In the lubricating grease composition, the porous polyamide particles preferably contain polyamide particles of at least one selected from the group consisting of nylon 6 (PA6), nylon 66 (PA66), and nylon 12 (PA12). Thus, the abrasion resistance, cold resistance, shock resistance, and oil resistance of the lubricating grease composition are improved by the polyamide particles, whereby the coefficient of static friction can be further increased to provide further improved starting performance, durability, and low-temperature performance.

The lubricating grease composition is preferably used for lubrication between resin members and between a resin member and a metal member. Thus, even if the lubricating grease composition is used for the sliding part between the resin members and between the resin member and the metal member, the coefficient of static friction in the sliding part can be further increased, and the starting performance, durability, and low-temperature performance of the resin member and metal member as the sliding member are improved.

The lubricating grease composition is preferably used for lubrication between gears of resin members and between a gear of a resin member and a gear of a metal member. Thus, even if the lubricating grease composition is used for the sliding part between the gears of the resin members and between the gear of the resin member and the gear of the metal member, the coefficient of static friction in the sliding part can be further increased, and the starting performance, the durability, and the low-temperature performance between the resin members and between the resin member and the metal member as the sliding member are improved.

Effects of Invention

The present invention can achieve a lubricating grease composition which can provide an increased coefficient of static friction between sliding members and has excellent starting performance, durability, and low-temperature performance.

DESCRIPTION OF EMBODIMENTS

Hereinafter, an embodiment of the present invention will be described in detail.

A lubricating grease composition according to the present invention contains: a base oil having a kinematic viscosity of 10 $mm^2/s$ or more and 60 $mm^2/s$ or less at 40° C.; a thickener containing at least one soap selected from the group consisting of a metal soap and a metal complex soap; and a solid lubricant containing porous polyamide particles. An amount of the porous polyamide particles is 1% by mass or more and 20% by mass or less based on a total mass of the lubricating grease composition.

In the lubricating grease composition according to the present invention, the kinematic viscosity of the base oil at 40° C. is 10 $mm^2/s$ or more, whereby the viscosity of the base oil moderately decreases, so that, even if a sliding member is quiescent under a high load for a long time, the starting performance of the sliding member is not deteriorated. The kinematic viscosity of the base oil at 40° C. is 60 $mm^2/s$ or less, whereby the viscosity of the base oil moderately increases, so that, even if sliding between members is performed for a long time, a sliding portion highly maintains a coefficient of static friction to provide improved durability, and an increase in a torque is suppressed even under low-temperature conditions to provide improved low-temperature performance. Furthermore, the amount of the porous polyamide particles blended is 1% by mass or more and 20% by mass or less based on the total mass of the lubricating grease composition, whereby the porous polyamide particles are contained in a moderate amount in the lubricating grease composition to provide an increased coefficient of static friction, thereby providing improved durability. This makes it possible to achieve the lubricating grease composition which can provide an increased coefficient of static friction between the sliding members and has excellent starting performance, durability, and low-temperature performance. Hereinafter, various components of the lubricating grease composition will be described in detail.

<Base Oil>

A base oil having a kinematic viscosity of 10 $mm^2/s$ or more and 60 $mm^2/s$ or less at 40° C. is used. If the base oil has a kinematic viscosity of 10 $mm^2/s$ or more at 40° C., the viscosity of the lubricating grease composition moderately decreases, whereby, even if a sliding member is quiescent under a high load for a long time, the starting performance of the sliding member is not deteriorated. If the base oil has a kinematic viscosity of 60 $mm^2/s$ or less at 40° C., the viscosity of the lubricating grease composition moderately increases, whereby, even if the sliding member slides for a long time, a decrease in the coefficient of static friction is prevented to provide improved durability, and an increase in a torque is suppressed even under low-temperature conditions to provide improved low-temperature performance. From the viewpoint of further improving the above-described effects, the kinematic viscosity of the base oil at 40° C. is preferably 12.5 $mm^2/s$ or more, more preferably 15 $mm^2/s$ or more, and still more preferably 17.5 $mm^2/s$ or more. The kinematic viscosity of the base oil at 40° C. is preferably 55 $mm^2/s$ or less, more preferably 50 $mm^2/s$ or less, and still more preferably 47.5 $mm^2/s$ or less.

The base oil preferably contains at least one synthetic oil of a synthetic hydrocarbon oil, an ester-based synthetic oil, an ether-based synthetic oil, and a glycol-based synthetic oil. The synthetic oils may be used singly, or used in combinations of two or more. Thus, the kinematic viscosity of the lubricating grease composition is easily adjusted within the above range, whereby the coefficient of static friction can be further increased to provide further improved starting performance, durability, and low-temperature performance.

As the synthetic hydrocarbon oil, various synthetic hydrocarbon oils can be used in a range exhibiting the effects of the present invention. The synthetic hydrocarbon oils may be used singly, or used in combinations of two or more. Among these, at least one synthetic hydrocarbon oil selected from the group consisting of poly-α-olefin (PAO), an ethylene-α-olefin oligomer, an ethylene-α-olefin copolymer, polybutene, alkylbenzene, and alkyl naphthalene is preferable, and at least one synthetic hydrocarbon oil selected from the group consisting of poly-α-olefin, an ethylene-α-olefin oligomer, an ethylene-α-olefin copolymer, and polybutene is more preferable. Thus, the base oil having a moderate viscosity is contained in the lubricating grease composition, whereby the coefficient of static friction can be further increased to provide further improved starting performance, durability, and low-temperature performance. The influence of the sliding member serving as a lubrication object on the resin of the resin member can be reduced to prevent deterioration in the resin member. From the viewpoint of allowing the influence of the sliding member on the resin of the resin member to be reduced to prevent deterioration in the resin member, the synthetic hydrocarbon oil is more preferably poly-α-olefin.

Examples of the ester-based synthetic oil include various ester oils such as diester, a polyol ester, and an aromatic ester. The ester-based synthetic oils may be used singly, or used in combinations of two or more.

Examples of the ether-based synthetic oil include various ether oils such as alkyl diphenyl ether. The ether-based synthetic oils may be used singly, or used in combinations of two or more.

Examples of the glycol-based synthetic oil include various glycol oils such as polyethylene glycol and polypropylene glycol. The glycol-based synthetic oils may be used singly, or used in combinations of two or more.

From the viewpoint of allowing the coefficient of static friction between the sliding members to be increased to impart excellent starting performance, durability, and low-temperature performance, the amount of the base oil blended is preferably 50% by mass or more and 100% by mass or less, preferably 60% by mass or more and 95% by mass or less, preferably 70% by mass or more and 90% by mass or less, and preferably 75% by mass or more and 87.5% by mass or less, based on the total mass of the lubricating grease composition.

<Thickener>

At least one soap selected from the group consisting of a metal soap and a metal complex soap is used as the thickener. As the metal soap and the metal complex soap, the metal soaps or the metal complex soaps may be used singly, or the metal soaps and the metal complex soaps may be used in combinations of two or more.

The metal soap and the metal complex soap are compounds of fatty acids or fatty acid derivatives such as stearic acids (such as 12-hydroxy stearic acid), azelaic acids such as azelaic acid, lauric acids, recinoleic acids, and octylic acids, and metals such as lithium, sodium, potassium, magnesium, calcium, barium, zinc, and aluminum.

Examples of the metal soap include a lithium soap, a sodium soap, a potassium soap, a calcium soap, a barium soap, and an aluminum soap. The metal soaps may be used singly, or used in combinations of two or more. Examples of the lithium soap include soaps of stearic acids using 12-hydroxystearic acid.

Examples of the metal complex soap include a lithium complex soap, a calcium complex soap, and a barium complex soap. The metal complex soaps may be used singly, or used in combinations of two or more. Examples of the lithium complex soap include soaps of stearic acids using 12-hydroxystearic acid and stearic acid.

Among these, the thickener preferably contains at least one soap selected from the group consisting of a lithium soap and a lithium complex soap. Thus, the lubricating grease composition contains the lithium soap and lithium complex soap having excellent heat resistance as the thickener, whereby the coefficient of static friction between the sliding members can be further increased.

From the viewpoint of allowing the coefficient of static friction between the sliding members to be increased to impart excellent starting performance and durability, the amount of the thickener blended is preferably 3% by mass or more, more preferably 5% by mass or more, and still more preferably 7.5% by mass or more, based on the total mass of the lubricating grease composition. From the viewpoint of providing high consistency to reduce a low-temperature torque, thereby imparting excellent low-temperature performance, the amount of the thickener blended is preferably 20% by mass or less, more preferably 19% by mass or less, and still more preferably 17% by mass or less. In view of the above, the amount of the thickener blended is preferably 3% by mass or more and 20% by mass or less, more preferably 5% by mass or more and 19% by mass or less, and still more preferably 7.5% by mass or more and 17% by mass or less, based on the total mass of the lubricating grease composition.

From the viewpoint of allowing the coefficient of static friction between the sliding members to be increased to impart excellent starting performance, durability, and low-temperature performance, the amount of the thickener blended is preferably 5% by mass or more and 30% by mass or less, more preferably 7.5% by mass or more and 25% by mass or less, and still more preferably 10% by mass or more and 21% by mass or less, based on 100 parts by mass of the base oil.

<Solid Lubricant>

The solid lubricant contains porous polyamide particles. As the porous polyamide particles, various types of porous polyamide particles can be used in a range exhibiting the effects of the present invention. The porous polyamide particles may be used singly, or used in combinations of two or more. Among these, from the viewpoint of allowing the coefficient of static friction between the sliding members to be increased to impart excellent starting performance, durability, and low-temperature performance, the porous polyamide particles preferably contain polyamide particles of at least one selected from the group consisting of nylon 6

(PA6), nylon 66 (PA66), and nylon 12 (PA12), and more preferably nylon 6 (PA6) and nylon 12 (PA12). Thus, the lubricating grease composition has improved abrasion resistance, cold resistance, shock resistance, and oil resistance, whereby the coefficient of static friction can be further increased to provide further improved starting performance, durability, and low-temperature performance.

The porous polyamide particles have different whole shape and surface shape from those of spherical polyamide particles. The spherical polyamide particles have a smooth surface and a perfect spherical shape. In contrast, the porous polyamide particles have a subspherical shape and a surface with many holes. The porous polyamide particles are porous, and have a large specific surface area, whereby, even if the average particle diameter is to some extent large, the porous polyamide particles may be contained in the lubricating grease composition in a state where the affinity of the porous polyamide particles for the base oil is good. The use of the porous polyamide particles as the solid lubricant makes it possible to increase the coefficient of static friction of the sliding member when the lubricating grease composition is used for the sliding member, whereby the coefficient of static friction at the time of starting after quiescence under a high load for a long time decreases to provide improved starting performance. Meanwhile, if the spherical polyamide particles have an average particle diameter of 5 μm or more, the affinity of the spherical polyamide particles for the base oil is deteriorated, so that the coefficient of static friction decreases to cause deteriorated starting performance of the sliding member. If the spherical polyamide particles have an average particle diameter of 50 μm or more, the spherical polyamide particles cannot enter into the sliding part of the sliding member, so that the coefficient of static friction decreases.

The porous polyamide particles preferably have an average particle diameter of 1 μm or more and 30 μm or less. Thus, the average particle diameter of the porous polyamide particles is 1 μm or more, whereby the average particle diameter of the porous polyamide particles moderately increases, so that the affinity of the porous polyamide particles for the base oil is good in a state where the coefficient of static friction between the sliding members using the lubricating grease composition is highly maintained, to provide increased starting performance of the sliding member using the lubricating grease composition. The porous polyamide particles have an average particle diameter of 30 μm or less, whereby the porous polyamide particles are likely to enter into between the sliding parts of the sliding members to provide an increased coefficient of static friction. From the viewpoint of allowing the coefficient of static friction between the sliding members to be increased to impart more excellent starting performance, durability, and low-temperature performance, the average particle diameter of the porous polyamide particles is preferably 2 μm or more, more preferably 3 μm or more, and still more preferably 4 μm or more. The average particle diameter of the porous polyamide particles is preferably 20 μm or less, more preferably 15 μm or less, and still more preferably 12.5 μm or less. In the present embodiment, the average particle diameter is a value measured by a laser diffraction/scattering type particle diameter distribution measuring device (model number: "LA-920", manufactured by Horiba, Ltd., principle of measurement: laser diffractometry).

From the viewpoint of allowing the coefficient of static friction between the sliding members to be increased to impart excellent starting performance, durability, and low-temperature performance, the porous polyamide particles preferably have a specific surface area of 2.0 $m^2/g$ or more. Thus, the average particle diameter of the porous polyamide particles moderately increases to provide good affinity of the porous polyamide particles for the base oil, whereby, even if the lubricating grease composition is quiescent under a high load for a long time, the coefficient of static friction at the time of starting decreases to provide improved starting performance. From the viewpoint of further improving the above-described effects, the specific surface area of the porous polyamide particles is preferably 2.2 $m^2/g$ or more, more preferably 2.3 $m^2/g$ or more, and still more preferably 2.4 $m^2/g$ or more. The upper limit of the specific surface area of the solid lubricant is not particularly limited. From the viewpoint of preventing a decrease in the consistency of the lubricating grease composition to reduce a low-temperature torque, the specific surface area of the solid lubricant is preferably 20 $m^2/g$ or less, more preferably 15 $m^2/g$ or less, still more preferably 12.5 $m^2/g$ or less, and yet still more preferably 10 $m^2/g$ or less. From the viewpoint that the particle diameter of the porous polyamide particles moderately increases to provide an increased coefficient of static friction, the specific surface area of the solid lubricant is particularly preferably 8.7 $m^2/g$ or less. In the present embodiment, the specific surface area is a value measured by specific surface area-micropore distribution: specific surface area/micropore distribution measuring device (model number "BELSORP-miniII", manufactured by MicrotracBEL Corp., principle of measurement: (constant-volume gas adsorption method)).

The amount of the porous polyamide particles blended is 1% by mass or more and 20% by mass or less based on the total mass of the lubricating grease composition. If the amount of the porous polyamide particles blended is 1% by mass or more and 20% by mass or less based on the total mass of the lubricating grease composition, the porous polyamide particles are contained in a moderate amount in the lubricating grease composition, whereby the coefficient of static friction increases to provide improved durability and starting performance. From the viewpoint of further improving the above-described effects, the amount of the porous polyamide particles blended is preferably 1.25% by mass or more, more preferably 1.5% by mass or more, and still more preferably 1.75% by mass or more, based on the total mass of the lubricating grease composition. The amount of the porous polyamide particles blended is preferably 17.5% by mass or less, more preferably 15% by mass or less, and still more preferably 12.5% by mass or less.

From the viewpoint of allowing the coefficient of static friction between the sliding members to be increased to impart excellent starting performance, durability, and low-temperature performance, the amount of the porous polyamide particles blended is preferably 1% by mass or more, more preferably 1.5% by mass or more, and still more preferably 2% by mass or more, based on 100 parts by mass of the base oil. The amount of the porous polyamide particles blended is preferably 22.5% by mass or less, more preferably 20% by mass or less, and still more preferably 17.5% by mass or less.

The lubricating grease composition may contain other substance in a range exhibiting the effects of the present invention. As the other substance, for example, an antioxidant, an extreme pressure agent, an anti-rust agent, an anti-corrosion agent, a viscosity index improver, and an oiliness agent and the like are appropriately selected and used.

Examples of the antioxidant include phenolic antioxidants such as 2,6-di-t-butyl-4-methyl phenol and 4,4'-methylene bis(2,6-di-t-butyl phenol), and amine-based antioxidants such as alkyl diphenylamine having an alkyl group having carbon atoms of 4 or more and 20 or less, triphenyl amine, phenyl-α-naphthylamine, phenothiazine, alkylated phenyl-α-naphthylamine, phenothiazine, and alkylated phenothiazine. The antioxidants may be used singly, or used in mixtures of two or more.

Examples of the extreme pressure agent include phosphorus compounds such as acid phosphate esther, phosphite ester, and acid amine phosphate esther, sulfur compounds such as sulfides and disulfides, chlorine compounds such as chlorinated paraffin and chlorinated diphenyl, and metal organic compounds such as dialkyl dithiophosphoric acid zinc (ZnDTP) and dialkyl dithiocarbamic acid molybdenum (MoDTP). The extreme pressure agents may be used singly, or used in mixtures of two or more.

Examples of the anti-rust agent include fatty acid, fatty acid soap, alkyl sulfonate, fatty acid amine, oxidized paraffin, and polyoxyethylene alkyl ether. The anti-rust agents may be used singly, or used in mixtures of two or more.

Examples of the anti-corrosion agent include benzotriazole, benzimidazole, and thiadiazole. The anti-corrosion agents may be used singly, or used in mixtures of two or more.

Examples of the viscosity index improver include a polymethacrylate, an ethylene-propylene copolymer, polyisobutylene, polyalkyl styrene, and a styrene-isoprene copolymer hydride. The viscosity index improvers may be used singly, or used in mixtures of two or more.

Examples of the oiliness agent include fatty acid, higher alcohol, polyhydric alcohol, polyhydric alcohol ester, aliphatic ester, aliphatic amine, and fatty acid monogliceride. The oiliness agents may be used singly, or used in mixtures of two or more.

The lubricating grease composition is preferably used for lubrication between resin members and between a resin member and a metal member as a sliding member. This can provide a further increased coefficient of static friction in the sliding part, and improved starting performance, durability, and low-temperature performance of the resin member and metal member as the sliding member even if the lubricating grease composition is used for the sliding part between the resin members and between the resin member and the metal member.

The lubricating grease composition is preferably used for lubrication between the gears of the resin members and between the gear of the resin member and the gear of the metal member. This can provide a further increased coefficient of static friction in the sliding part, and improved starting performance, durability, and low-temperature performance of the gear of the resin member and the gear of the metal member as the sliding member even if the lubricating grease composition is used for the sliding part between the gears of the resin members and between the gear of the resin member and the gear of the metal member.

Examples of the resin of the resin member as the sliding member for which the lubricating grease composition is used include various resins such as polyethylen (PE), polypropylene (PP), an acrylonitrile butadiene styrene copolymer (ABS resin), polyacetal (POM), nylon (PA), polycarbonate (PC), a phenol resin (PF), polyethylene terephthalate (PET), polybutylene terephthalate (PBT), polyphenylene sulfide (PPS), polyethersulfone (PES), polyimide (PI), and polyether ether ketone (PEEK). Examples of the metal of the metal member as the sliding member for which the lubricating grease composition is used include various metals such as stainless steel, iron, steel, and copper.

A grease as the lubricating grease composition is applied on a metal plate as a test specimen under various test conditions using a stick-slip tester (reciprocating tester) (manufactured by Shinko Engineering Co., Ltd.), and an upper resin test specimen is pressed to the metal plate from above. A coefficient of static friction can be measured from a frictional force occurring between the resin ball and the metal plate while the resin ball is reciprocally slid.

From the viewpoint that the lubricating grease composition has a sufficient quiescence function, a coefficient of static friction during the first sliding in a reciprocating test performed under the following conditions is preferably 0.15 or more.

<Test Conditions>

Upper test specimen: POM cylinder (diameter: 10 mm, length: 10 mm)

Lower test specimen: S45C plate (metal plate)

Test force: 1 kgf

Amount of grease applied: 0.05 g

Sliding rate: 5 mm/sec

Test temperature: 80° C.

Sliding distance: 10 mm

From the viewpoint that the lubricating grease composition has sufficient durability, a coefficient of static friction during the 100th sliding in a reciprocating test performed under the following conditions is preferably 0.15 or more.

<Test Conditions>

Upper test specimen: POM cylinder (diameter: 10 mm, length: 10 mm)

Lower test specimen: S45C plate (metal plate)

Test force: 1 kgf

Amount of grease applied: 0.05 g

Sliding rate: 5 mm/sec

Test temperature: 80° C.

Sliding distance: 10 mm

Furthermore, from the viewpoint that the lubricating grease composition has sufficient starting performance, a coefficient of static friction during the first sliding after quiescence for 16 hours in a high force load state in a reciprocating test performed under the following conditions is preferably 0.1 or less.

<Test Conditions>

Upper test specimen: POM cylinder (diameter: 10 mm)

Lower test specimen: S45C plate (metal plate)

Test force: 10 kgf

Amount of grease applied: 0.05 g

Sliding rate: 5 mm/sec

Test temperature: 80° C.

Sliding distance: 10 mm

From the viewpoint that the lubricating grease composition has sufficient low-temperature torque performance, a starting low-temperature torque is preferably 20 N·cm or less. The starting low-temperature torque is measured at a test temperature of −40° C. in accordance with "Test Method for Low-Temperature Torque" specified in JIS K 2220. 18.

The lubricating grease composition according to the present invention can be widely applied to parts for business machines such as copying machines and printers, power transmission apparatuses such as reduction gears, speed increasers, gears, chains, and motors, traveling system parts, brake system parts such as an anti lock brake system (ABS), steering system parts, driving system parts such as converters, auxiliary parts for automobiles such as power window motors, power seat motors, and sunroof motors, electronic information instruments, hinge parts for mobile phones and the like, various parts in the food-pharmaceutical industry, the steel, construction, glass industries, the cement industry, film tenters, the chemical, rubber, and resin industries, the environment-power facility, the paper making-printing industries, the timber industry, and the fiber-apparel industry, and relative motion-involving machine parts, and the like. The lubricating grease composition according to the present invention can also be applied to bearings such as ball bearings, thrust bearings, kinetic pressure bearings, resin bearings, and translation bearings.

As described above, in the lubricating grease composition according to the embodiment, the kinematic viscosity of the base oil at 40° C. is 10 $mm^2/s$ or more, whereby the viscosity of the base oil moderately decreases, so that, even if the sliding member is quiescent under a high load for a long time, the starting performance is not deteriorated. In the lubricating grease composition, the kinematic viscosity of the base oil at 40° C. is 60 $mm^2/s$ or less, whereby the viscosity of the base oil moderately increases, so that, even if sliding between the sliding members is performed for a long time, the coefficient of static friction of the sliding part is highly maintained to provide improved durability, and an increase in a torque is suppressed even under low-temperature conditions to provide improved low-temperature performance. Furthermore, in the lubricating grease composition, the amount of the porous polyamide particles blended is 1% by mass or more and 20% by mass or less based on the total mass of the lubricating grease composition, whereby the porous polyamide particles are contained in a moderate amount in the lubricating grease composition, so that the coefficient of static friction increases to provide improved durability. Therefore, the lubricating grease composition can provide an increased coefficient of static friction between the sliding members and have excellent starting performance, durability, and low-temperature performance.

EXAMPLES

Hereinafter, the present invention will be described in more detail based on Examples performed in order to clarify the effects of the present invention. The present invention is not limited at all by the following Examples and Comparative Examples.

Example 1

Poly-α-olefin (kinematic viscosity at 40° C.: 18 $mm^2/s$, trade name "DURASYN (registered trademark) 164", manufactured by INEOS Oligomers Japan) was used as a base oil. As a thickener, a lithium soap was used, which was obtained by mixing 12-hydroxystearic acid (manufactured by KF TRADING CO., LTD.) with lithium hydroxide. 84 parts by mass of the poly-α-olefin, and the 12-hydroxystearic acid (manufactured by KF TRADING CO., LTD.) and lithium hydroxide (manufactured by Honjo Chemical Corporation) set such that the amount of lithium soap was 13 parts by mass were stirred with heating at 80° C. or higher and 130° C. or lower in a mixing and stirring tank for a saponification reaction. Thereafter, the mixture was stirred with heating to a melting temperature, and then cooled to about 100° C. to produce a gelatinous substance. Subsequently, to the gelatinous substance, 2 parts by mass of porous polyamide particles (PA6) (average particle diameter: 13 μm, specific surface area: 3.6 $m^2/g$, trade name "TR1", manufactured by Toray Industries, Inc.) as a solid lubricant, and 1 part by mass of phenyl naphthylamine (trade name "VANLUBE (registered trademark) 81", manufactured by Sanyo Chemical Industries, Ltd.) as an antioxidant were added, followed by stirring. The stirred gelatinous substance was passed through a roll mill or a high-pressure homogenizer to prepare a lubricating grease composition, and the prepared lubricating grease composition was evaluated. Coefficients of static friction in quiescence function evaluation, durability evaluation, and starting performance evaluation were 0.16, 0.16, and 0.08, respectively. Low-temperature performance evaluation was 18 N·cm. The amount of the lubricating grease composition blended and the evaluation results thereof are shown in the following Table 1. With respect to the amount of each component forming the thickener, the amounts of the 12-hydroxystearic acid and lithium hydroxide based on the total mass of the thickener were 88% by mass and 12% by mass, respectively.

Example 2

A lubricating grease composition was prepared and evaluated in the same manner as in Example 1 except that 11 parts by mass of a lithium soap was blended, and 4 parts by mass of a solid lubricant was blended. Coefficients of static friction in quiescence function evaluation, durability evaluation, and starting performance evaluation were 0.17, 0.18, and 0.06, respectively. Low-temperature performance evaluation was 16 N·cm. The amount of the lubricating grease composition blended and the evaluation results thereof are shown in the following Table 1.

Example 3

A lubricating grease composition was prepared and evaluated in the same manner as in Example 1 except that 78 parts by mass of poly-α-olefin (kinematic viscosity at 40° C.: 18 $mm^2/s$, trade name "DURASYN (registered trademark) 164", manufactured by INEOS Oligomers Japan) was blended; 16 parts by mass of a lithium soap was blended; and 6 parts by mass of porous polyamide particles (PA6) (average particle diameter: 13 μm, specific surface area: 3.6 $m^2/g$, trade name "TR1", manufactured by Toray Industries, Inc.) were blended as a solid lubricant. Coefficients of static friction in quiescence function evaluation, durability evaluation, and starting performance evaluation were 0.19, 0.20, and 0.08, respectively. Low-temperature performance evaluation was 19 N·cm. The amount of the lubricating grease composition blended and the evaluation results thereof are shown in the following Table 1.

Example 4

A lubricating grease composition was prepared and evaluated in the same manner as in Example 1 except that 82 parts by mass of poly-α-olefin (kinematic viscosity at 40° C.: 18 $mm^2/s$, trade name "DURASYN (registered trademark) 164", manufactured by INEOS Oligomers Japan) was blended; 9 parts by mass of a lithium soap was blended; and 8 parts by mass of a solid lubricant was blended. Coefficients of static friction in quiescence function evaluation, durability evaluation, and starting performance evaluation were 0.18, 0.18, and 0.07, respectively. Low-temperature performance evaluation was 15 N·cm. The amount of the lubricating grease composition blended and the evaluation results thereof are shown in the following Table 1.

Example 5

A lubricating grease composition was prepared and evaluated in the same manner as in Example 1 except that 11 parts by mass of a lithium soap was blended, and 4 parts by mass of porous polyamide particles (PA6) (average particle diameter: 13 μm, specific surface area: 2.5 $m^2/g$, trade name "TR2", manufactured by Toray Industries, Inc.) were blended as a solid lubricant in place of 2 parts by mass of porous polyamide particles (PA6) (average particle diameter: 13 μm, specific surface area: 3.6 $m^2/g$, trade name "TR1", manufactured by Toray Industries, Inc.). Coefficients of static friction in quiescence function evaluation, durability evaluation, and starting performance evaluation were 0.20, 0.21, and 0.09, respectively. Low-temperature performance evaluation was 16 N·cm. The amount of the lubricating grease composition blended and the evaluation results thereof are shown in the following Table 1.

Example 6

A lubricating grease composition was prepared and evaluated in the same manner as in Example 1 except that 85 parts by mass of poly-α-olefin (kinematic viscosity at 40° C.: 18 $mm^2/s$, trade name "DURASYN (registered trademark) 164", manufactured by INEOS Oligomers Japan) was blended; 10 parts by mass of a lithium soap was blended; and 4 parts by mass of porous polyamide particles (PA12) (average particle diameter: 5 μm, specific surface area: 8.7 $m^2/g$, trade name "ORGASOL (registered trademark) 2001 UD", manufactured by ARKEMA K.K.) were blended as a solid lubricant in place of 2 parts by mass of porous polyamide particles (PA6) (average particle diameter: 13 μm, specific surface area: 3.6 $m^2/g$, trade name "TR1", manufactured by Toray Industries, Inc.). Coefficients of static friction in quiescence function evaluation, durability evaluation, and starting performance evaluation were 0.17, 0.16, and 0.08, respectively. Low-temperature performance evaluation was 16 N·cm. The amount of the lubricating grease composition blended and the evaluation results thereof are shown in the following Table 1.

Example 7

A lubricating grease composition was prepared and evaluated in the same manner as in Example 1 except that 85 parts by mass of poly-α-olefin (kinematic viscosity at 40° C.: 18 $mm^2/s$, trade name "DURASYN (registered trademark) 164", manufactured by INEOS Oligomers Japan) was blended; 10 parts by mass of a lithium soap was blended; and 4 parts by mass of porous polyamide particles (PA12) (average particle diameter: 10 μm, specific surface area: 2.5 $m^2/g$, trade name "ORGASOL (registered trademark) 2001 EXD", manufactured by ARKEMA K.K.) were blended as a solid lubricant in place of 2 parts by mass of porous polyamide particles (PA6) (average particle diameter: 13 μm, specific surface area: 3.6 $m^2/g$, trade name "TR1", manufactured by Toray Industries, Inc.). Coefficients of static friction in quiescence function evaluation, durability evaluation, and starting performance evaluation were 0.17, 0.18, and 0.08, respectively. Low-temperature performance evaluation was 16 N·cm. The amount of the lubricating grease composition blended and the evaluation results thereof are shown in the following Table 1.

Example 8

Poly-α-olefin (kinematic viscosity at 40° C.: 18 $mm^2/s$, trade name "DURASYN (registered trademark) 164", manufactured by INEOS Oligomers Japan) was used as a base oil. As a thickener, a lithium complex soap was used, which was obtained by mixing 12-hydroxystearic acid (manufactured by KF TRADING CO., LTD.), lithium hydroxide (manufactured by Honjo Chemical Corporation), and azelaic acid (manufactured by Emery Oleochemicals Japan Ltd.). 82 parts by mass of the poly-α-olefin, and the 12-hydroxystearic acid and lithium hydroxide set such that the amount of the lithium complex soap was 13 parts by mass were stirred with heating at 80° C. or higher and 130° C. or lower in a mixing and stirring tank for a saponification reaction. Thereafter, azelaic acid was added thereto, and the mixture was stirred with heating at 80° C. or higher and 200° C. or lower. Lithium hydroxide (manufactured by Honjo Chemical Corporation) was added thereto, to perform a saponification reaction again, thereby forming a lithium complex soap. The lithium complex soap was then cooled to about 100° C. to produce a gelatinous substance. Subsequently, to the gelatinous substance, 4 parts by mass of porous polyamide particles (PA6) (average particle diameter: 13 μm, specific surface area: 3.6 $m^2/g$, trade name "TR1", manufactured by Toray Industries, Inc.) as a solid lubricant, and 1 part by mass of phenyl naphthylamine (trade name "VANLUBE (registered trademark) 81", manufactured by Sanyo Chemical Industries, Ltd.) as an antioxidant were added, followed by stirring. The stirred gelatinous substance was passed through a roll mill or a high-pressure homogenizer to prepare a lubricating grease composition, and the prepared lubricating grease composition was evaluated. Coefficients of static friction in quiescence function evaluation, durability evaluation, and starting performance evaluation were 0.17, 0.17, and 0.06, respectively. Low-temperature performance evaluation was 17 N·cm. The amount of the lubricating grease composition blended and the evaluation results thereof are shown in the following Table 1. With respect to the amount of each component forming the thickener, the amounts of the 12-hydroxystearic acid, azelaic acid, and lithium hydroxide based on the total mass of the thickener were 63.5% by mass, 19% by mass, and 17.5% by mass, respectively.

Example 9

A lubricating grease composition was prepared and evaluated in the same manner as in Example 1 except that 79 parts by mass of poly-α-olefin (kinematic viscosity at 40° C.: 30 $mm^2/s$, trade name "DURASYN (registered trademark) 166", manufactured by INEOS Oligomers Japan) was blended as a base oil in place of 84 parts by mass of poly-α-olefin (kinematic viscosity at 40° C.: 18 $mm^2/s$, trade name "DURASYN (registered trademark) 164", manufactured by INEOS Oligomers Japan); 8 parts by mass of a lithium soap was blended; and 12 parts by mass of porous polyamide particles (PA6) (average particle diameter: 13 μm, specific surface area: 3.6 $m^2/g$, trade name "TR1", manufactured by Toray Industries, Inc.) were blended. Coefficients of static friction in quiescence function evaluation, durability evaluation, and starting performance evaluation were 0.20, 0.19, and 0.09, respectively. Low-temperature performance evaluation was 18 N·cm. The amount of the lubricating grease composition blended and the evaluation results thereof are shown in the following Table 1.

Example 10

A lubricating grease composition was prepared and evaluated in the same manner as in Example 8 except that 82 parts by mass of poly-α-olefin (kinematic viscosity at 40° C.: 30 $mm^2/s$, trade name "DURASYN (registered trademark)

166", manufactured by INEOS Oligomers Japan) was blended as a base oil in place of 82 parts by mass of poly-α-olefin (kinematic viscosity at 40° C.: 18 $mm^2/s$, trade name "DURASYN (registered trademark) 164", manufactured by INEOS Oligomers Japan); 9 parts by mass of a lithium complex soap was blended; and 8 parts by mass of porous polyamide particles (PA12) (average particle diameter: 10 μm, specific surface area: 2.5 $m^2/g$, trade name "ORGASOL (registered trademark) 2001 EXD", manufactured by ARKEMA K.K.) were blended as a solid lubricant in place of 4 parts by mass of porous polyamide particles (PA6) (average particle diameter: 13 μm, specific surface area: 3.6 $m^2/g$, trade name "TR1", manufactured by Toray Industries, Inc.). Coefficients of static friction in quiescence function evaluation, durability evaluation, and starting performance evaluation were 0.19, 0.19, and 0.09, respectively. Low-temperature performance evaluation was 18 N~cm. The amount of the lubricating grease composition blended and the evaluation results thereof are shown in the following Table 1.

Example 11

A lubricating grease composition was prepared and evaluated in the same manner as in Example 8 except that 81 parts by mass of poly-α-olefin (kinematic viscosity at 40° C.: 30 $mm^2/s$, trade name "DURASYN (registered trademark) 166", manufactured by INEOS Oligomers Japan) was blended as a base oil in place of 82 parts by mass of poly-α-olefin (kinematic viscosity at 40° C.: 18 $mm^2/s$, trade name "DURASYN (registered trademark) 164", manufactured by INEOS Oligomers Japan); 10 parts by mass of a lithium complex soap was blended; and 8 parts by mass of porous polyamide particles (PA6) (average particle diameter: 13 μm, specific surface area: 3.6 $m^2/g$, trade name "TR1", manufactured by Toray Industries, Inc.) were blended. Coefficients of static friction in quiescence function evaluation, durability evaluation, and starting performance evaluation were 0.19, 0.18, and 0.06, respectively. Low-temperature performance evaluation was 18 N·cm. The amount of the lubricating grease composition blended and the evaluation results thereof are shown in the following Table 1.

Example 12

A lubricating grease composition was prepared and evaluated in the same manner as in Example 1 except that 85 parts by mass of poly-α-olefin (kinematic viscosity at 40° C.: 46 $mm^2/s$, trade name "DURASYN (registered trademark) 168", manufactured by INEOS Oligomers Japan) was blended as a base oil in place of 84 parts by mass of poly-α-olefin (kinematic viscosity at 40° C.: 18 $mm^2/s$, trade name "DURASYN (registered trademark) 164", manufactured by INEOS Oligomers Japan); 10 parts by mass of a lithium soap was blended; and 4 parts by mass of porous polyamide particles (PA6) (average particle diameter: 13 μm, specific surface area: 3.6 $m^2/g$, trade name "TR1", manufactured by Toray Industries, Inc.) were blended. Coefficients of static friction in quiescence function evaluation, durability evaluation, and starting performance evaluation were 0.16, 0.16, and 0.07. Low-temperature performance evaluation was 19 N·cm. The amount of the lubricating grease composition blended and the evaluation results thereof are shown in the following Table 1.

Comparative Example 1

A lubricating grease composition was prepared and evaluated in the same manner as in Example 1 except that 82 parts by mass of poly-α-olefin (kinematic viscosity at 40° C.: 18 $mm^2/s$, trade name "DURASYN (registered trademark) 164", manufactured by INEOS Oligomers Japan) was blended as a base oil; 9 parts by mass of a lithium soap was blended; and 8 parts by mass of spherical polyamide particles (PA12) (average particle diameter: 5 μm, specific surface area: 1.2 $m^2/g$, trade name "SP-500", manufactured by Toray Industries, Inc.) were blended as a solid lubricant in place of 2 parts by mass of porous polyamide particles (PA6) (average particle diameter: 13 μm, specific surface area: 3.6 $m^2/g$, trade name "TR1", manufactured by Toray Industries, Inc.). Coefficients of static friction in quiescence function evaluation, durability evaluation, and starting performance evaluation were 0.18, 0.20, and 0.12, respectively. Low-temperature performance evaluation was 16 N·cm. The amount of the lubricating grease composition blended and the evaluation results thereof are shown in the following Table 2.

Comparative Example 2

A lubricating grease composition was prepared and evaluated in the same manner as in Comparative Example 1 except that 8 parts by mass of spherical polyamide particles (PA12) (average particle diameter: 10 μm, specific surface area: 0.7 $m^2/g$, trade name "SP-10", manufactured by Toray Industries, Inc.) were blended as a solid lubricant in place of 8 parts by mass of spherical polyamide particles (PA12) (average particle diameter: 5 μm, specific surface area: 1.2 $m^2/g$, trade name "SP-500", manufactured by Toray Industries, Inc.). Coefficients of static friction in quiescence function evaluation, durability evaluation, and starting performance evaluation were 0.19, 0.20, and 0.12, respectively. Low-temperature performance evaluation was 17 N·cm. The amount of the lubricating grease composition blended and the evaluation results thereof are shown in the following Table 2.

Comparative Example 3

A lubricating grease composition was prepared and evaluated in the same manner as in Comparative Example 1 except that 8 parts by mass of spherical polyamide particles (PA6) (average particle diameter: 50 μm, specific surface area: 0.1 $m^2/g$, trade name "1001P", manufactured by Toray Industries, Inc.) were blended as a solid lubricant in place of 8 parts by mass of spherical polyamide particles (PA12) (average particle diameter: 5 μm, specific surface area: 1.2 $m^2/g$, trade name "SP-500", manufactured by Toray Industries, Inc.). Coefficients of static friction in quiescence function evaluation, durability evaluation, and starting performance evaluation were 0.13, 0.13, and 0.09, respectively. Low-temperature performance evaluation was 16 N·cm. The amount of the lubricating grease composition blended and the evaluation results thereof are shown in the following Table 2.

Comparative Example 4

A lubricating grease composition was prepared and evaluated in the same manner as in Example 8 except that 4 parts by mass of spherical polyamide particles (PA12) (average particle diameter: 5 μm, specific surface area: 1.2 $m^2/g$, trade name "SP-500", manufactured by Toray Industries, Inc.) were blended as a solid lubricant in place of 4 parts by mass of porous polyamide particles (PA6) (average particle diameter: 13 μm, specific surface area: 3.6 $m^2/g$, trade name "TR1", manufactured by Toray Industries, Inc.). Coefficients of static friction in quiescence function evaluation, durability evaluation, and starting performance evaluation were 0.18, 0.19, and 0.11, respectively. Low-temperature performance evaluation was 16 N·cm. The amount of the lubricating grease composition blended and the evaluation results thereof are shown in the following Table 2.

Comparative Example 5

A lubricating grease composition was prepared and evaluated in the same manner as in Example 1 except that 90.5 parts by mass of poly-α-olefin (kinematic viscosity at 40° C.: 30 $mm^2/s$, trade name "DURASYN (registered trademark) 166", manufactured by INEOS Oligomers Japan) was blended as a base oil in place of 84 parts by mass of poly-α-olefin (kinematic viscosity at 40° C.: 18 $mm^2/s$, trade name "DURASYN (registered trademark) 164", manufactured by INEOS Oligomers Japan); 8 parts by mass of a lithium soap was blended; and 0.5 parts by mass of porous polyamide particles (PA6) (average particle diameter: 13 μm, specific surface area: 3.6 $m^2/g$, trade name "TR1", manufactured by Toray Industries, Inc.) were blended. Coefficients of static friction in quiescence function evaluation, durability evaluation, and starting performance evaluation were 0.16, 0.12, and 0.08, respectively. Low-temperature performance evaluation was 18 N·cm. The amount of the lubricating grease composition blended and the evaluation results thereof are shown in the following Table 2.

Comparative Example 6

A lubricating grease composition was prepared and evaluated in the same manner as in Example 1 except that 70 parts by mass of poly-α-olefin (kinematic viscosity at 40° C.: 30 $mm^2/s$, trade name "DURASYN (registered trademark) 166", manufactured by INEOS Oligomers Japan) was blended as a base oil in place of 84 parts by mass of poly-α-olefin (kinematic viscosity at 40° C.: 18 $mm^2/s$, trade name "DURASYN (registered trademark) 164", manufactured by INEOS Oligomers Japan); 8 parts by mass of a lithium soap was blended; and 21 parts by mass of porous polyamide particles (PA6) (average particle diameter: 13 μm, specific surface area: 3.6 $m^2/g$, trade name "TR1", manufactured by Toray Industries, Inc.) were blended. Coefficients of static friction in quiescence function evaluation, durability evaluation, and starting performance evaluation were 0.22, 0.20, and 0.11, respectively. Low-temperature performance evaluation was 20 N·cm. The amount of the lubricating grease composition blended and the evaluation results thereof are shown in the following Table 2.

Comparative Example 7

A lubricating grease composition was prepared and evaluated in the same manner as in Example 1 except that 84 parts by mass of poly-α-olefin (kinematic viscosity at 40° C.: 68 $mm^2/s$, trade name "DURASYN (registered trademark) 170", manufactured by INEOS Oligomers Japan) was blended as a base oil in place of 84 parts by mass of poly-α-olefin (kinematic viscosity at 40° C.: 18 $mm^2/s$, trade name "DURASYN (registered trademark) 164", manufactured by INEOS Oligomers Japan); 11 parts by mass of a lithium soap was blended; and 4 parts by mass of porous polyamide particles (PA6) (average particle diameter: 13 μm, specific surface area: 3.6 $m^2/g$, trade name "TR1", manufactured by Toray Industries, Inc.) were blended as a solid lubricant. Coefficients of static friction in quiescence function evaluation, durability evaluation, and starting performance evaluation were 0.16, 0.13, and 0.06, respectively. Low-temperature performance evaluation was 30 N·cm. The amount of the lubricating grease composition blended and the evaluation results thereof are shown in the following Table 2.

Comparative Example 8

A lubricating grease composition was prepared and evaluated in the same manner as in Example 1 except that 84 parts by mass of poly-α-olefin (kinematic viscosity at 40° C.: 5 $mm^2/s$, trade name "DURASYN (registered trademark) 162", manufactured by INEOS Oligomers Japan) was blended as a base oil in place of 84 parts by mass of poly-α-olefin (kinematic viscosity at 40° C.: 18 $mm^2/s$, trade name "DURASYN (registered trademark) 164", manufactured by INEOS Oligomers Japan); 11 parts by mass of a lithium soap was blended; and 4 parts by mass of porous polyamide particles (PA6) (average particle diameter: 13 μm, specific surface area: 3.6 $m^2/g$, trade name "TR1", manufactured by Toray Industries, Inc.) were blended as a solid lubricant. Coefficients of static friction in quiescence function evaluation, durability evaluation, and starting performance evaluation were 0.16, 0.19, and 0.12, respectively. Low-temperature performance evaluation was 14 N·cm. The amount of the lubricating grease composition blended and the evaluation results thereof are shown in the following Table 2.

Comparative Example 9

A lubricating grease composition was prepared and evaluated in the same manner as in Example 1 except that 81 parts by mass of poly-α-olefin (kinematic viscosity at 40° C.: 30 $mm^2/s$, trade name "DURASYN (registered trademark) 166", manufactured by INEOS Oligomers Japan) was blended as a base oil in place of 84 parts by mass of poly-α-olefin (kinematic viscosity at 40° C.: 18 $mm^2/s$, trade name "DURASYN (registered trademark) 164", manufactured by INEOS Oligomers Japan); 8 parts by mass of a lithium soap was blended; and 10 parts by mass of calcium carbonate (average particle diameter: 30 μm, trade name "SFT-2000", manufactured by Sankyo Seifun K.K.) was blended as a solid lubricant in place of 2 parts by mass of porous polyamide particles (PA6) (average particle diameter: 13 μm, specific surface area: 3.6 $m^2/g$, trade name "TR1", manufactured by Toray Industries, Inc.). Coefficients of static friction in quiescence function evaluation, durability evaluation, and starting performance evaluation were 0.24, 0.21, and 0.15, respectively. Low-temperature performance evaluation was 17 N·cm. The amount of the lubricating grease composition blended and the evaluation results thereof are shown in the following Table 2.

Comparative Example 10

A lubricating grease composition was prepared and evaluated in the same manner as in Example 1 except that 80 parts by mass of poly-α-olefin (kinematic viscosity at 40° C.: 30 $mm^2/s$, trade name "DURASYN (registered trademark) 166", manufactured by INEOS Oligomers Japan) was blended as a base oil in place of 84 parts by mass of poly-α-olefin (kinematic viscosity at 40° C.: 18 $mm^2/s$, trade name "DURASYN (registered trademark) 164", manufactured by INEOS Oligomers Japan); 8 parts by mass of a lithium soap was blended; and 1 part by mass of polytetrafluoroethylene (PTFE) (trade name "Dyneon (registered trademark) TF9207", manufactured by 3M Japan Limited) and 10 parts by mass of melamine cyanurate (MCA) (trade name "MC-6000", manufactured by Nissan Chemical Corporation) were used in combination as a solid lubricant in place of 2 parts by mass of porous polyimide particles (PA6) (average particle diameter: 13 μm, specific surface area: 3.6 $m^2/g$, trade name "TR1", manufactured by Toray Industries, Inc.). Coefficients of static friction in quiescence function evaluation, durability evaluation, and starting performance evaluation were 0.13, 0.21, and 0.13, respectively. Low-temperature performance evaluation was 18 N·cm. The amount of the lubricating grease composition blended and the evaluation results thereof are shown in the following Table 2.

<Evaluation Methods>

According to the following tests, quiescence function evaluation, durability evaluation, and starting performance evaluation were performed. In each of the evaluations, a grease was applied on a metal plate as a lower test specimen under various test conditions using a stick-slip tester (reciprocating tester) (manufactured by Shinko Engineering Co., Ltd.). An upper resin test specimen was pressed to the metal plate from above, and reciprocally slid. The evaluations were performed based on a coefficient of static friction measured from a frictional force occurring between the resin ball and the metal plate.

(Quiescence Function Evaluation)

A reciprocating test was performed under the following conditions. A coefficient of static friction during the first sliding was evaluated according to the following criteria.

0.15 or more: Good less than 0.15: Poor

<Test Conditions>

Upper test specimen: POM cylinder (diameter: 10 mm, length: 10 mm)

Lower test specimen: S45C plate (metal plate)

Test force: 1 kgf

Amount of grease applied: 0.05 g

Sliding rate: 5 mm/sec

Test temperature: 80° C.

Sliding distance: 10 mm (Durability Evaluation)

A reciprocating test was performed under the following conditions. A coefficient of static friction during the 100th sliding was evaluated according to the following criteria.

0.15 or more: Good less than 0.15: Poor

<Test Conditions>

Upper test specimen: POM cylinder (diameter: 10 mm, length: 10 mm)

Lower test specimen: S45C plate (metal plate)

Test force: 1 kgf

Amount of grease applied: 0.05 g

Sliding rate: 5 mm/sec

Test temperature: 80° C.

Sliding distance: 10 mm (Starting Performance Evaluation)

A reciprocating test was performed under the following conditions. A coefficient of static friction during the first sliding after quiescence for 16 hours in an overload state was evaluated according to the following criteria.

0.1 or less: Good exceed 0.1: Poor

<Test Conditions>

Upper test specimen: POM ball (diameter: 10 mm)

Lower test specimen: S45C plate (metal plate)

Test force: 10 kgf

Amount of grease applied: 0.05 g

Sliding rate: 5 mm/sec

Test temperature: 80° C.

Sliding distance: 10 mm (Low-Temperature Performance Evaluation)

A starting torque was measured at a test temperature of −40° C. in accordance with "Test Method for Low-Temperature Torque" specified in JIS K 2220. 18. The starting torque was evaluated according to the following criteria.

20 N·cm or less: Good exceed 20 N·cm: Poor

TABLE 1

| | Examples | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Base oil A | 84 | 84 | 78 | 82 | 84 | 85 | 85 | 82 | | | | |
| Base oil B | | | | | | | | | 79 | 82 | 81 | |
| Base oil C | | | | | | | | | | | | 85 |
| Thickener A | 13 | 11 | 16 | 9 | 11 | 10 | 10 | | 8 | | | 10 |
| Thickener B | | | | | | | | 13 | | 9 | 10 | |
| Solid lubricant A | 2 | 4 | 6 | 8 | | | | 4 | 12 | | 8 | 4 |
| Solid lubricant B | | | | | 4 | | | | | | | |
| Solid lubricant C | | | | | | 4 | | | | | | |
| Solid lubricant D | | | | | | | 4 | | | 8 | | |
| Antioxidant | 1 | 1 | 1 | 1 | 1 | 1 | 1 | 1 | 1 | 1 | 1 | 1 |
| Total | 100 | 100 | 100 | 100 | 100 | 100 | 100 | 100 | 100 | 100 | 100 | 100 |
| Kinematic viscosity of base oil at 40° C. ($mm^2/s$) | 18 | 18 | 18 | 18 | 18 | 18 | 18 | 18 | 30 | 30 | 30 | 46 |
| Quiescence function evaluation | Good | Good | Good | Good | Good | Good | Good | Good | Good | Good | Good | Good |
| (coefficient of static friction) | (0.16) | (0.17) | (0.19) | (0.18) | (0.20) | (0.17) | (0.17) | (0.17) | (0.20) | (0.19) | (0.19) | (0.16) |
| Durability evaluation | Good | Good | Good | Good | Good | Good | Good | Good | Good | Good | Good | Good |
| (coefficient of static friction) | (0.16) | (0.18) | (0.20) | (0.18) | (0.21) | (0.16) | (0.18) | (0.17) | (0.19) | (0.19) | (0.18) | (0.16) |
| Starting performance evaluation | Good | Good | Good | Good | Good | Good | Good | Good | Good | Good | Good | Good |
| (coefficient of static friction) | (0.08) | (0.06) | (0.08) | (0.07) | (0.09) | (0.08) | (0.08) | (0.06) | (0.09) | (0.09) | (0.06) | (0.07) |
| Low-temperature performance evaluation (N · cm) | Good (18) | Good (16) | Good (19) | Good (15) | Good (16) | Good (16) | Good (16) | Good (17) | Good (18) | Good (18) | Good (18) | Good (19) |

TABLE 2

| | Comparative Examples | | | | | | | | | |
|---|---|---|---|---|---|---|---|---|---|---|
| | 1 | 2 | 3 | 4 | 5 | 6 | 7 | 8 | 9 | 10 |
| Base oil A | 82 | 82 | 82 | 82 | | | | | | |
| Base oil B | | | | | 90.5 | 70 | | | 81 | 80 |
| Base oil D | 84 | | | | | | | | | |
| Base oil E | 84 | | | | | | | | | |
| Thickener A | 9 | 9 | 9 | | 8 | 8 | 11 | 11 | 8 | 8 |
| Thickener B | | | | 13 | | | | | | |
| Solid lubricant A | | | | | 0.5 | 21 | 4 | 4 | | |
| Solid lubricant E | 8 | | | 4 | | | | | | |
| Solid lubricant F | | 8 | | | | | | | | |
| Solid lubricant G | | | 8 | | | | | | | |
| Solid lubricant H | | | | | | | | | 10 | |
| Solid lubricant I | | | | | | | | | | 1 |
| Solid lubricant J | | | | | | | | | | 10 |
| Antioxidant | 1 | 1 | 1 | 1 | 1 | 1 | 1 | 1 | 1 | 1 |
| Total | 100 | 100 | 100 | 100 | 100 | 100 | 100 | 100 | 100 | 100 |
| Kinematic viscosity of base oil at 40° C. ($mm^2/s$) | 18 | 18 | 18 | 18 | 30 | 30 | 68 | 5 | 30 | 30 |
| Quiescence function evaluation (coefficient of static friction) | Good (0.18) | Good (0.19) | Poor (0.13) | Good (0.18) | Good (0.16) | Good (0.22) | Good (0.16) | Good (0.16) | Good (0.24) | Poor (0.13) |
| Durability evaluation (coefficient of static friction) | Good (0.20) | Good (0.20) | Poor (0.13) | Good (0.19) | Poor (0.12) | Good (0.20) | Poor (0.13) | Good (0.19) | Good (0.21) | Good (0.21) |
| Starting performance evaluation (coefficient of static friction) | Poor (0.12) | Poor (0.12) | Good (0.09) | Poor (0.11) | Good (0.08) | Poor (0.11) | Good (0.06) | Poor (0.12) | Poor (0.15) | Poor (0.13) |
| Low-temperature performance evaluation (N · cm) | Good (16) | Good (17) | Good (16) | Good (16) | Good (18) | Good (20) | Poor (30) | Good (14) | Good (17) | Good (18) |

The amounts of components blended in Table 1 above are as follows.

Base oil A: Poly-α-olefin (kinematic viscosity at 40° C.: 18 $mm^2/g$, trade name "DURASYN (registered trademark) 164", manufactured by INEOS Oligomers Japan)

Base oil B: Poly-α-olefin (kinematic viscosity at 40° C.: 30 $mm^2/g$, trade name "DURASYN (registered trademark) 166", manufactured by INEOS Oligomers Japan)

Base oil C: Poly-α-olefin (kinematic viscosity at 40° C.: 46 $mm^2/g$, trade name "DURASYN (registered trademark) 168", manufactured by INEOS Oligomers Japan)

Base oil D: Poly-α-olefin (kinematic viscosity at 40° C.: 68 $mm^2/g$, trade name "DURASYN (registered trademark) 170", manufactured by INEOS Oligomers Japan)

Base oil E: Poly-α-olefin (kinematic viscosity at 40° C.: 5 $mm^2/g$, trade name "DURASYN (registered trademark) 162", manufactured by INEOS Oligomers Japan)

Thickener A: Lithium soap (own composite)

Thickener B: Lithium complex soap (own composite)

Solid lubricant A: Porous polyamide particles (PA6) (average particle diameter: 13 μm, specific surface area: 3.6 $m^2/g$, trade name "TR1", manufactured by Toray Industries, Inc.)

Solid lubricant B: Porous polyamide particles (PA6) (average particle diameter: 13 μm, specific surface area: 2.5 $m^2/g$, trade name "TR2", manufactured by Toray Industries, Inc.)

Solid lubricant C: Porous polyamide particles (PA12) (average particle diameter: 5 μm, specific surface area: 8.7 $m^2/g$, trade name "ORGASOL (registered trademark) 2001 UD", manufactured by ARKEMA K.K.)

Solid lubricant D: Porous polyamide particles (PA12) (average particle diameter: 10 μm, specific surface area: 2.5 $m^2/g$, trade name "ORGASOL (registered trademark) 2001 EXD", manufactured by ARKEMA K.K.)

Solid lubricant E: Spherical polyamide particles (PA12) (average particle diameter: 5 μm, specific surface area: 1.2 $m^2/g$, trade name "SP-500", manufactured by Toray Industries, Inc.)

Solid lubricant F: Spherical polyamide particles (PA12) (average particle diameter: 10 μm, specific surface area: 0.7 $m^2/g$, trade name "SP-10", manufactured by Toray Industries, Inc.)

Solid lubricant G: Spherical polyamide particles (PA6) (average particle diameter: 50 μm, specific surface area: 0.1 $m^2/g$, trade name "1001P", manufactured by Toray Industries, Inc.)

Solid lubricant H: Calcium carbonate (average particle diameter: 30 μm, trade name "SFT-2000", manufactured by Sankyo Seifun K.K.)

Solid lubricant I: Polytetrafluoroethylene (PTFE) (trade name "Dyneon (registered trademark) TF9207", manufactured by 3M Japan Limited)

Solid lubricant J: Melamine cyanurate (MCA) (trade name "MC-6000", manufactured by Nissan Chemical Corporation)

Antioxidant: Phenyl naphthylamine (trade name "VANLUBE (registered trademark) 81", manufactured by Sanyo Chemical Industries, Ltd.)

As apparent from Table 1, it is found that the lubricating grease composition contains: a base oil containing a synthetic hydrocarbon oil having a kinematic viscosity of 10 $mm^2/s$ or more and 60 $mm^2/s$ or less at 40° C.; a thickener containing at least one selected from the group consisting of a lithium soap and a lithium complex soap; and a solid lubricant containing porous polyamide particles having a specific surface area of 2.0 $m^2/g$ or more and an average particle diameter of 1 μm or more and 30 μm or less, wherein an amount of the porous polyamide particles is 1% by mass or more and 20% by mass or less based on a total mass of the lubricating grease composition, to provide excellent results in quiescence function evaluation, durability evaluation, starting performance evaluation, and low-temperature performance evaluation (Example 1 to Example 12). From the results, it is found that the lubricating grease compositions according to the present Examples can achieve a high quiescence function, and excellent durability, starting performance, and low-temperature performance.

Meanwhile, as apparent from Table 2, it is found that, when a solid lubricant containing spherical polyamide particles having a specific surface area of less than 2.0 $m^2/g$ is contained, starting performance evaluation is deteriorated (Comparative Example 1, Comparative Example 2, and Comparative Example 4). According to this result, it is considered that, because the specific surface area of the spherical polyamide particles used as the solid lubricant is too small to cause deteriorated affinity of the spherical polyamide particles for the base oil, a coefficient of static friction at the time of starting after quiescence under a high load for a long time increases to cause deteriorated starting performance. It is found that, when the average particle diameter of the solid lubricant exceeds 30 μm, quiescence function evaluation and durability evaluation are deteriorated (Comparative Example 3). According to this result, it is considered that as the average particle diameter of the solid lubricant is too large, the spherical polyamide particles cannot sufficiently enter into between the sliding members to cause an increased coefficient of static friction, as a result of which a sufficient quiescence function and durability are not obtained.

In addition, it is found that, when the amount of the solid lubricant blended is less than 1 part by mass based on the total mass of the lubricating grease composition even if the specific surface area of the solid lubricant is 2.0 $m^2/g$ or more and the porous polyamide particles having an average particle diameter of 1 μm or more and 30 μm or less are contained, durability evaluation is deteriorated (Comparative Example 5). According to this result, it is considered that because the porous polyamide particles are too few, a sufficient coefficient of static friction is not obtained to cause deteriorated durability. Furthermore, it is found that, when the amount of the solid lubricant blended exceeds 20 parts by mass based on the total mass of the lubricating grease composition even if the specific surface area of the solid lubricant is 2.0 $m^2/g$ or more and the porous polyamide particles having an average particle diameter of 1 μm or more and 30 μm or less are contained, starting performance evaluation is deteriorated (Comparative Example 6). According to this result, it is considered that too many porous polyamide particles make the coefficient of static friction at the time of starting too high to cause deteriorated starting performance.

It is also found that, when the kinematic viscosity of the base oil at 40° C. exceeds 60 $mm^2/s$, durability evaluation and low-temperature performance evaluation are deteriorated (Comparative Example 7). According to this result, it is considered that because the viscosity of the base oil is too high, a sufficient lubrication performance is not obtained. Furthermore, it is found that, when the kinematic viscosity at 40° C. is less than 10 $mm^2/s$, starting performance evaluation is deteriorated (Comparative Example 8). According to this result, it is considered that because the viscosity of the base oil is too low, a sufficient coefficient of static friction is not obtained at the time of starting. It is found that, when calcium carbonate is contained as the solid lubricant, starting performance evaluation is deteriorated (Comparative Example 9). According to this result, it is considered that because sufficient lubrication performance is not obtained by the calcium carbonate, a sufficient coefficient of static friction is not obtained at the time of starting. Furthermore, it is found that, when polytetrafluoroethylene and melamine cyanurate which are conventionally used are contained as the solid lubricant, quiescence function evaluation and starting performance evaluation are deteriorated (Comparative Example 10). According to this result, it is considered that a sufficient lubrication performance is not obtained in a quiescent state and at the time of starting by the conventional solid lubricant.

As described above, it is found that the present Examples can achieve a lubricating grease composition which can provide an increased coefficient of static friction between sliding members and has excellent starting performance, durability, and low-temperature performance.

INDUSTRIAL APPLICABILITY

The present invention has an effect allowing achievement of a lubricating grease composition which can provide an increased coefficient of static friction between sliding members and has excellent starting performance, durability, and low-temperature performance. For example, the present invention can be suitably used for power transmission apparatuses such as reduction gears, speed increasers, gears, chains, and motors, traveling system parts, braking system parts such as ABS, steering system parts, driving system parts such as converters, and auxiliary parts for automobiles such as power window motors, power seat motors, and sunroof motors, and the like.

As above, the embodiment of the present invention has been described, but the embodiment of the present invention is not limited by the contents of the present embodiment. The above-described components include those which can be easily thought of by those skilled in the art, substantially the same elements, and those in a range of so-called equivalents. Furthermore, the above-described components can be appropriately combined. Furthermore, various kinds of omission, replacement, and change of the components are possible within a range not departing from the scope of the gist of the above-described embodiments.

The invention claimed is:

1. A lubricating grease composition comprising:

a base oil having a kinematic viscosity of 10 $mm^2/s$ or more and 60 $mm^2/s$ or less at 40° C.;

a thickener containing at least one soap selected from the group consisting of a metal soap and a metal complex soap; and a solid lubricant containing porous polyamide particles, wherein an amount of the porous polyamide particles blended is 1% by mass or more and 20% by mass or less based on a total mass of the lubricating grease composition; and the porous polyamide particles have a specific surface area of 2.0 $m^2/g$ or more; and the porous polyamide particles contain polyamide particles of at least one selected from the group consisting of nylon 6 (PA6) and nylon 66 (PA66).

2. The lubricating grease composition according to claim 1, wherein the porous polyamide particles have an average particle diameter of 1 μm or more and 30 μm or less.

3. The lubricating grease composition according to claim 1, wherein the thickener is at least one soap selected from the group consisting of a lithium soap and a lithium complex soap.

4. The lubricating grease composition according to claim 1, wherein the base oil contains at least one synthetic oil selected from the group consisting of a synthetic hydrocarbon oil, an ester-based synthetic oil, an ether-based synthetic oil, and a glycol-based synthetic oil.

5. The lubricating grease composition according to claim 1, wherein the base oil contains at least one synthetic hydrocarbon oil selected from the group consisting of poly-α-olefin, an ethylene-α-olefin oligomer, an ethylene-α-olefin copolymer, polybutene, alkylbenzene, and alkyl naphthalene.

6. The lubricating grease composition according to claim 1, wherein the lubricating grease composition is used for lubrication between resin members and between a resin member and a metal member.

7. The lubricating grease composition according to claim 1, wherein the lubricating grease composition is used for lubrication between gears of resin members and between a gear of a resin member and a gear of a metal member.

* * * * *